US005601043A

United States Patent [19]

Grunder

[11] Patent Number: 5,601,043

[45] Date of Patent: Feb. 11, 1997

[54] METHOD OF MANUFACTURING THREAD-STITCHED BOOKS AND ARRANGEMENT FOR CARRYING OUT THE METHOD

[75] Inventor: Roland Grunder, Vordemwald, Switzerland

[73] Assignee: Grapha-Holding AG, Hergiswil, Switzerland

[21] Appl. No.: 388,167

[22] Filed: Feb. 10, 1995

Related U.S. Application Data

[63] Continuation of Ser. No. 54,000, Apr. 26, 1993, abandoned.

[30] Foreign Application Priority Data

May 2, 1992 [CH] Switzerland ..... 01410/92

[51] Int. Cl.[6] ..... B42C 19/08

[52] U.S. Cl. ..... 112/475.04; 112/21; 112/475.07; 412/35

[58] Field of Search ..... 112/21, 22, 262.3, 112/262.1, 304, 475.08, 475.04, 475.07; 412/35, 1; 270/58, 54, 58.08

[56] References Cited

U.S. PATENT DOCUMENTS 4,401,299 8/1983 Muller ..... 270/54
4,704,973 11/1987 Horst ..... 112/21
5,112,179 5/1992 Chan et al. ..... 412/1

FOREIGN PATENT DOCUMENTS 0149058 7/1985 European Pat. Off. .
3532403 4/1986 Germany .
3602320 8/1986 Germany .
503595 2/1970 Switzerland ..... B42C 19/08

OTHER PUBLICATIONS

Printroll P–220 System—the key to fully automated finishing Date: Mar. 1990 Switzerland, pp. 2 and 3.

*Primary Examiner*—Peter Nerbun
*Attorney, Agent, or Firm*—Friedrich Kueffner

[57] ABSTRACT

A method of manufacturing thread-stitched books and an arrangement for carrying out the method, the method including gathering individual folded printed sheets into sheet blocks in a gathering unit, and loading after each gathering cycle the sheet blocks onto a block receiving unit of a storage unit releasably connected to the gathering unit. Batches of the sheet blocks are supplied to at least one book sewing machine. Subsequently, the sheets are sewn together into book blocks in the at least one book sewing machine.

14 Claims, 1 Drawing Sheet

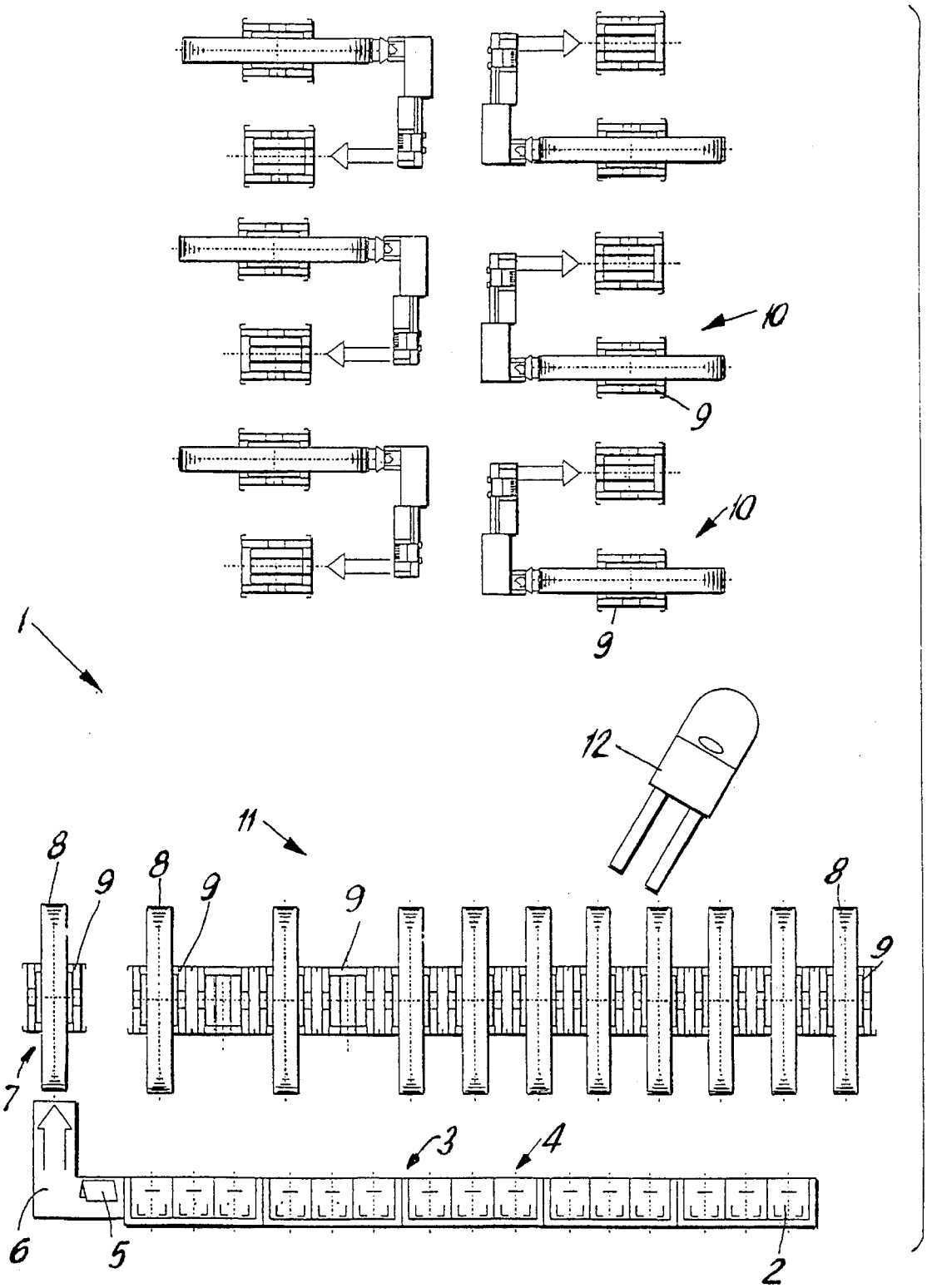
1
2
3
4
5
6
7
8
9
10
11
12

METHOD OF MANUFACTURING THREAD-STITCHED BOOKS AND ARRANGEMENT FOR CARRYING OUT THE METHOD

This is a continuation of application Ser. No. 08/054,000 filed Apr. 26, 1993, now abandoned.

BACKGROUND OF THE INVENTION

1. Field of the Invention

The present invention relates to a method of manufacturing thread-stitched books. The method includes gathering folded printed sheets into blocks and later binding the printed sheets into a book block by sewing the individual printed sheets together.

The present invention further relates to an arrangement for carrying out the above-described method. The arrangement includes a gathering unit with several feeder stations for different printed sheets and at least one subsequently arranged book sewing machine.

2. Description of the Related Art

In a machine arrangement for thread-stitching of book blocks disclosed in CH-A-503,595, blocks manufactured from printed sheets in a gathering machine or device are transferred at the stack discharge or delivering unit to a coplanar conveyor belt. Feeders of a book sewing machine for the blocks are arranged along the conveyor belt. Operating personnel load the blocks arriving on the conveyor belt onto the feeders. In a method carried out on the machine arrangement of CH-A-503,595, the blocks are placed on pallets at the end of the gathering machine and the pallets are moved into a storage area until the blocks are further processed in the book sewing machines. The filled pallets are transported from the storage area to the feeders of the book sewing machines and the blocks are manually placed in the feeders.

In newer arrangements, a machine is used for loading the book sewing machine directly from the gathering unit.

The manual loading is very labor intensive because the feeders of the book sewing machine or machines have to be loaded and/or the printed sheets gathered into blocks have to be placed into intermediate storage. The intermediate storage is necessary because of the output ratio between gathering unit and book sewing machine, wherein the gathering unit is capable of gathering a plurality of blocks during the time that the book sewing machine is capable of finishing a book block. The reason for the substantially longer processing time in the book sewing machine is the fact that each individual printed sheet of a block is being sewed. In other words, during each work cycle of the gathering unit, a block is made available at the delivery unit which cannot be processed completely by the book sewing machine within the same period of time because the capacity of the book sewing machine is smaller.

On the other hand, it would not be economical to increase the sewing capacity by increasing the number of book sewing machines and by providing extensive conveyor units when a greater order is to be filled.

When the gathering unit and the book sewing machine or machines are directly connected, an economical manufacture is only possible if a smaller number of units is to be produced, so that an intermediate storage of the blocks is not necessary. Other disadvantages of known arrangements of the above-described type are described in the relevant technical literature.

SUMMARY OF THE INVENTION

Therefore, it is the primary object of the present invention to provide a method and an arrangement of the above-described type in which the disadvantages described above are eliminated in a simple manner and under economically favorable conditions.

In accordance with the present invention, the blocks formed by the gathered printed sheets are received after the gathering cycle in a releasably coupled block receiving unit of a storage means and are supplied in batches or charges from the storage means to the book sewing machines.

The method of the present invention makes it possible to feed blocks successively to the units intended for receiving the blocks, and to subsequently move the units as required to an intermediate storage or to one or more book sewing machines.

In accordance with an advantageous feature, each block receiving unit can receive at least one charge of blocks intended for a book sewing machine, so that a flexible processing sequence is possible. The unit for receiving the blocks composed of gathered and folded printed sheets advantageously is a mobile drivable coil as it is used for loose printed products available in shingle-type formation. Such coils permit an efficient storage of the blocks in the layers produced by the coiled belts.

The blocks can be placed in the layers of the coil either spaced apart or successively without spacing, or they may be placed staggered in a shingle-type formation, for example, in the case of large-size thin blocks.

In order to prevent displacements between the printed sheets and/or to prevent a squeezing effect which subsequently generates undesirable creases, the blocks are arranged in such a way that the blocks are introduced into the coil with the rears of the printed sheets entering first.

An arrangement suitable for carrying out the method of the present invention composed of a gathering unit with several feeder stations for different printed sheets and at least one subsequently arranged book sewing machine includes a mobile block receiving unit of a storage means, wherein the block receiving unit is coupled in a releasable manner to the discharge or delivery end of the gathering unit and is driven so as to operate with the same cycle as the gathering unit.

The arrangement according to the present invention makes it possible to maintain an optimum operation of the gathering unit and to provide a buffer-type intermediate storage for carrying out a flexible operation in the available book sewing machines.

The storage unit is preferably arranged between the gathering unit and the book sewing machine or machines, so that long and time-consuming transportation paths are avoided and the required space can be utilized in an optimum manner.

The block receiving units can be transported between the gathering unit and book sewing machine or machines by means of automotive carriages, such as lifting trucks or the like, or by controlled units traveling on rails or by crane units which operate in the same manner.

A drivable coil is particularly advantageous as the block receiving unit. The drivable coil offers a large receiving volume within a relatively small space and is simple to transport, wherein the coil itself is constructed so as to be motor-driven.

In accordance with an advantageous feature, the storage unit and the corresponding block receiving units are connected for control with the gathering unit and/or the book sewing machine or machines or can be adapted to the production output of the book sewing machine or machines and can be used without operating personnel. Accordingly, it has become possible to automatically control and regulate the production of the book blocks from the gathering machine to the book sewing machine or machines.

Finally, the block receiving units can be utilized for the intermediate storage of the finished book blocks until the book blocks are further processed.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there is illustrated and described a preferred embodiment of the invention.

BRIEF DESCRIPTION OF THE DRAWING

In the drawing:

The single FIGURE of the drawing schematically illustrates an arrangement for the manufacture of thread-stitched books in accordance with the present invention.

DESCRIPTION OF THE PREFERRED EMBODIMENT

The drawing schematically illustrates on arrangement 1 for the manufacture of thread-stitched books. In the arrangement 1, folded printed sheets stacked in feeder stations 2 are gathered into blocks 5 on a conveyor path 3 of a gathering unit 4. The printed sheets which have been gathered into blocks 5 are fed to a block receiving unit 7 through a delivery unit 6 at the end of the gathering unit 4. The block receiving unit 7 is constructed as a winding station.

The delivery unit 6 extending to the winding station is composed, for example, of a belt conveyor which, seen in conveying direction, is followed by at least one winding belt fastened to a winding spindle or mandrel. The winding spindle, not shown, is mounted so as to be rotatable about its axis. One end of the winding belt is fastened to the winding spindle and the other end of the winding belt is fastened to a rotatable winding drum, not shown. The winding belt is guided over guide rollers and is driven by a motor which is connected to the winding spindle. The speed of the winding belt is controlled in accordance with the speed at which the blocks 5 are supplied. The winding spindle of a produced coil 8 is supported in a coil stand 9.

The coil stand 9 may be movable in a manner not illustrated in detail or may be constructed so as to be movable by means of a crane. When using a lifting truck, it is also possible to transport the coil 8 by itself into a coil stand 9 located near a book sewing machine 10.

As illustrated in the drawing, a filled coil 8 is moved away from the gathering unit 4 and is about to be transported into the adjacent storage unit 11 in which already a plurality of coils 8 are placed on coil stands 9 next to each other and are stored until they are further transported to the book sewing machines 10. The illustrated configuration of the coils 8 can be transported on guide rails mounted on the floor, by a crane or by the illustrated lifting truck 12. The illustrated position of the storage unit 11 within the arrangement 1 is also arbitrary and is to be adapted to the specific requirements.

Of course, the relative configuration of the gathering unit, storage unit and book sewing machine or machines could also be selected differently, particularly in such a way that an advantageous sequence of operations can be carried out. The manner in which the book sewing machines 10 are arranged is also arbitrary and could be changed.

The book sewing machines 10 are loaded with batches by means of the block receiving units 7, wherein one or more batches and even batches of book blocks of different types can be placed in a coil 8.

As illustrated in the drawing, the storage unit 11 also includes empty coil stands 9 from which a coil 8 has been removed or to which a coil 8 is to be supplied.

Additional coil stands 9 with coil spindles for receiving book blocks after the book blocks have been sewn in the book sewing machines 10 are arranged following the book sewing machines 10 wherein the components of the coils are exchangeable with those of the storage unit 11.

It should be understood that the preferred embodiment and examples described are for illustrative purposes only and are not to be construed as limiting the scope of the present invention which is properly delineated only in the appended claims.

I claim:

1. A method of manufacturing thread-stitched books, the method comprising gathering individual folded printed sheets into sheet blocks in a gathering unit carrying out gathering cycles, loading the sheet blocks after each gathering cycle on a block receiving unit of a storage means releasably connected to the gathering unit, supplying batches of the sheet bloks to at least one book sewing machine, and subsequently binding the printed sheets into book blocks by sewing together the individual printed sheets in the at least one book sewing machine.

2. The method according to claim 1, comprising loading at least one batch of sheet blocks on the block receiving unit.

3. The method according to claim 1, comprising storing the sheet blocks in mobile drivable coils.

4. The method according to claim 3, comprising arranging the sheet blocks successively in layers in one of the coils.

5. The method according to claim 4, comprising arranging the sheet blocks such that backs of the printed sheets enter the coil first.

6. The method according to claim 3, comprising utilizing the coils for an intermediate storage of the book blocks.

7. An arrangement for manufacturing thread-stitched books, the arrangement comprising a gathering unit including a plurality of feeder stations for gathering folded printed sheets into sheet blocks, the gathering unit having a delivery end, at least one book sewing machine for sewing the printed sheets into book blocks, a storage means comprising at least one mobile block receiving unit for receiving the sheet blocks from the gathering unit and for supplying the sheets blocks to the at least one book sewing machine, and means for operatively connecting and disconnecting the delivery end of the gathering unit to the at least one block receiving unit.

8. The arrangement according to claim 7, wherein the storage unit is arranged between the gathering unit and the book sewing machine.

9. The arrangement according to claim 7, comprising means for moving the at least one block receiving unit between the storage unit and the book sewing machine.

10. The arrangement according to claim 9, wherein the moving means is a movable stand.

11. The arrangement according to claim 9, wherein the moving means is a crane.

12. The arrangement according to claim 7, wherein the block receiving means comprises a motor-driven coil.

13. The arrangement according to claim 8, comprising control means for connecting the storage unit to the gathering unit.

14. The arrangement according to claim 8, comprising control means for connecting the storage unit to the book sewing machine.

* * * * *